United States Patent [19]

Mochizuki

[11] 4,204,418

[45] May 27, 1980

[54] MACHINE AND METHOD FOR ELECTRIC FORGING OF THE END OF A METALLIC STICK IN A PLANE GENERALLY PERPENDICULAR TO THE STICK

[75] Inventor: Toraji Mochizuki, Tokyo, Japan

[73] Assignee: Nippon Dentan Co., Ltd., Tokyo, Japan

[21] Appl. No.: 942,777

[22] Filed: Sep. 15, 1978

[51] Int. Cl.[2] ..... B21J 9/08

[52] U.S. Cl. ..... 72/352; 72/364; 72/377; 72/406; 219/7.5

[58] Field of Search ..... 72/342, 352, 361, 364, 72/377, 406; 219/7.5, 10.41; 29/527.1, DIG. 13, DIG. 18, DIG. 21, DIG. 29; 10/24, 27 H

[56] References Cited

U.S. PATENT DOCUMENTS

| | | | |
|---|---|---|---|
| 1,805,124 | 5/1931 | Wilcox | 29/DIG. 18 |
| 2,676,229 | 4/1954 | Knight | 72/364 |
| 3,198,928 | 8/1965 | Allison | 219/7.5 |
| 3,406,555 | 10/1968 | Fuchs, Jr. | 72/377 |

*Primary Examiner*—Michael J. Keenan
*Attorney, Agent, or Firm*—Cantor and Singer

[57] ABSTRACT

A machine and method whereby a metallic stick is pressed into a mold which is moved along two axes substantially perpendicularly to the stick so as to make the end of the stick follow the mold while it is softened by heat produced by passage of an electric current between the mold and the stick, the stick only being moved in its axial direction while the mold is only moved in the two substantially perpendicular directions to this axial direction.

3 Claims, 3 Drawing Figures

MACHINE AND METHOD FOR ELECTRIC FORGING OF THE END OF A METALLIC STICK IN A PLANE GENERALLY PERPENDICULAR TO THE STICK

This invention relates to a machine and a method for making integrally a relatively complicated head on one end of a metallic rod or stick by electric forging.

In the prior art, if an L-shaped metallic head B as shown in FIG. 2 is to be formed on one end of a metallic stick A as shown in FIGS. 1 and 2, it has usually been produced by a cutting and welding process, or by precision forging.

If the L-shaped head and the stick are connected together by welding, it is impossible to unite perfectly the compositions of the two members to be joined, and the heating involves leaving of internal stresses in the materials and alteration of their compositions, resulting in insufficient mechanical strength of the finished product. Thus the applications of the object manufactured are restricted.

Further, cutting and welding involves a fair degree of skill, and a lot of time. Further, a lot of chips are produced, and the percentage of rejects is high. All this means high cost.

When an electric upsetter or an upset forging machine or the like is used for precision forging of such a head, skilled operation is required, and hence productivity is low. Further, the treatment of the exhaust gas from the furnace of such a machine is expensive, and the machine vibrates a lot and is noisy. To prevent this vibration again means high cost.

An electric forging machine has been developed in which a head is made on the end of a stick by pushing the stick in its axial direction, and by passing a current from the stick to a block which it is pushed against. However, in this case only a simple head at the end of the stick can be made, and a complicated head cannot be made.

Therefore, it is an object of the present invention to provide a machine and a method for making integrally a relatively complicated head on one end of a metallic stick by electric forging, free from the abovementioned defects, which are quick, accurate, and easily practiced.

According to the present invention, there is provided a machine for making a head on the end of a metallic stick by electric forging, said head being of a shape generally extending in a plane substantially perpendicular to the stick, comprising: an electrode means which holds the stick, and which moves in the axial direction of the stick; moving means which is movable along two axes in a plane perpendicular to the axial direction of the stick; a mold having a mold groove corresponding to the form desired for the head, which is mounted to the moving means; and a current supply means which is connected to the electrode means and to the mold.

Further, according to the present invention, there is provided a method for making a head on the end of a metallic stick by electric forging, said head being of a shape generally extending in a plane perpendicular to the stick, comprising: pushing a metallic stick in its axial direction into a mold groove formed in a mold while the stick is softened by heat produced by its internal resistance by leading a current between the stick and the mold; and moving the mold along two axes in the plane substantially perpendicular to the stick, thereby distributing the softened metal about in the mold groove, while the stick is not substantially moved except in its axial direction.

In order that the details of the present invention may be better understood, one preferred embodiment will now be described with reference to the accompanying drawings, in which.

Figure 2:
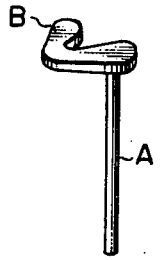
FIG. 2 is a perspective view of a finished article made according to the present invention.

In FIG. 2, a processed article comprising a metallic stick A and an L-shaped head B attached to it, which is to be made by the method and machine of the present invention, is shown. The L-shaped head extends generally in a plane perpendicular to the stick, and itself is generally of the form of a curved line. This is the kind of head which is best suited to manufacture by the present invention.

Figure 3:
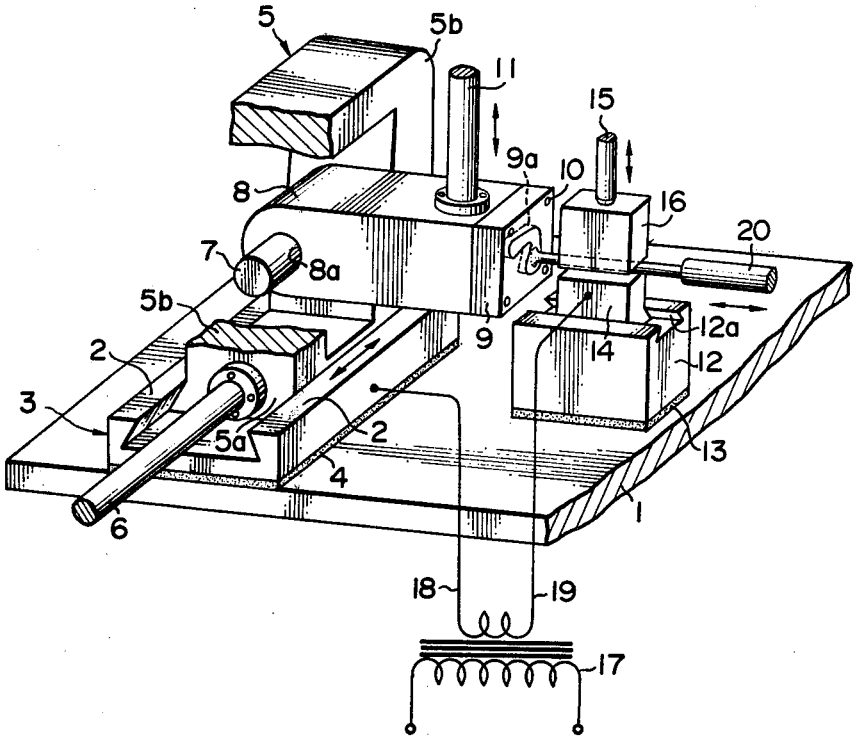
FIG. 3 is a perspective view of a machine according to the present invention.

In FIG. 3, which shows a machine of the present invention, a support member 3 having a groove which is formed by a pair of projections 2 which project upwards and extend in the front and rear directions as seen in the figure is mounted on a base 1 via an insulation plate 4.

A slide member 5 having a rectangular frame shape is slidably fitted in the groove of the support member 3. A horizontal shaft 6 is mounted on the lowermost front surface 5*a* of the slide member 5, and this is slid forwards and backwards in the groove of the support member 3 by means of a hydraulic actuator not shown connected to the shaft 6.

A horizontal support shaft 7 is secured between a pair of vertical portions 5*b* of the slide member 5. Over this support shaft 7 is fitted a pivot member 8 having a horizontal hole 8*a* on its left side portion as seen in the figure. A mold 9 having a mold groove 9*a* which is of the shape of the head B to be molded is mounted to the right side as seen in the figure of the pivot member 8, by bolts 10. A vertical shaft 11 is mounted on the right end upper surface of the pivot member 8, and this pivot member 8 is moved up and down by means of a hydraulic actuator not shown which is coupled to the shaft 11.

A guide member 12 having a guide groove 12*a* in its upper surface, which extends rightwards and leftwards, is mounted to the base 1 via an insulation plate 13 on the right side of the support member 3.

Figure 1:
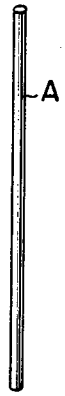
FIG. 1 is a perspective view of a metallic stick which is used as a material in the present invention.

A sliding electrode 14 having a solid rectangular form is slidably fitted in the guide groove 12*a* of the guide member 12. An upper sliding electrode member 16 is arranged immediately above the sliding electrode 14, and is moved up and down by a vertical shaft 15 fixed to its upper surface. Also, when a metallic stick as in FIG. 1 is fitted in between the sliding electrode 14 and the upper sliding electrode member 16, as shown in the figure, a push member 20 is provided which may be attached to the right hand end of the stick, so as to move the stick together with the members 14 and 16 rightwards and leftwards.

All members except the insulation plates 4 and 13 are made of conducting material. Each of the slide shaft 6 and the vertical shafts 11 and 15 is isolated electrically from the member which actuates it, which is not shown.

The support member 3 and the slide electrode 14 are connected to the output terminals of the second coil of a transformer 17, the primary coil of which is connected to an electric source which is not shown, via lead wires 18 and 19.

The softening temperature point of the stick A is of course lower than that of the mold 9.

The material of the stick A may be iron, iron alloy, stainless steel, copper, copper alloy, or the like.

The operation of making the head B on one end of the stick A will now be described.

The metallic stick A is placed and held between the sliding electrode 14 and the upper sliding electrode member 16, and its right end is pushed towards the mold 9 by the push member 20. The stick A is moved leftward together with the electrodes 14 and 16, and its left hand end contacts the mold groove 9*a* of the mold 9. Current then flows between these, and the stick A is heated up by its internal resistance. It soon softens, although, according to the present invention, it does not melt.

While the stick A is pushed towards the mold 9 by the push member 20, the mold is moved in the directions substantially perpendicular to the axial direction of the stick by sliding the slide member 5 by the slide shaft 6 and by pivoting the pivot member 8 around the support shaft 7 by the vertical shaft 11.

By properly synchronizing the motion of the mold in the horizontal and vertical directions substantially perpendicular to the axial direction of the stick, always pressing the stick towards the mold as it melts, the softened metal can be distributed around in the mold groove. The operation is stopped by cutting the current supply when the head B has been formed and the stick is in the correct position relative to it. Thus the head is formed according to the exact shape of the mold.

According to the present invention, one example was made under the following conditions:

Metallic stick: diameter 13 mm material—chrome steel of Japanese industrial standard SCr-21

L-shaped head: length 55 mm, width 17 mm, thickness 12 mm, total breadth 55 mm current flow: 8500 amperes forging temperature: 1050° C.

pushing force in the axial direction of the stick: 2.5 tonnes pushing force for the slide member 5: 2.5 tonnes moving force for the pivot member 8: 2.5 tonnes.

processing time: 16 seconds

Although the present invention has been shown and described in terms of a preferred embodiment, various changes and omissions of the form and detail thereof may be made therein by those skilled in the art without departing from the scope of the invention. For example, the mold groove on the mold might be not L-shaped, but C-shaped, Z-shaped, V-shaped, or the like. A moving member which moved up and down, along a slot on the slide member 5, might be used instead of the pivot member 8. Other possible alterations will be easy to imagine for one skilled in the mechanical arts. Therefore it is desired that the protection and monopoly granted should not be limited by any details of the embodiment which has been used for the purposes of illustration of the invention, but only by the accompanying claims.

What is claimed is:

1. A method for making a head on the end of a metallic stick by electric forging, said head being of a shape generally extending in a plane perpendicular to the stick, comprising:

pushing a metallic stick in its axial direction into a mold groove formed in a mold while the stick is softened by heat generated by its internal resistance by leading a current between the stick and the mold;

and moving the mold along two axes in the plane substantially perpendicular to the stick, thereby distributing the softened metal about in the mold groove, while the stick is not substantially moved except in its axial direction.

2. A machine for making a head on the end of a metallic stick by electric forging, said head being of a shape generally extending in a plane perpendicular to the stick, comprising:

an electrode means which holds the stick, and which is movable in the axial direction of the stick;

moving means which is movable along two axes in a plane substantially perpendicular to the axial direction of the stick;

a mold having a mold groove corresponding to the form desired for the head, which is mounted to the moving means;

and a current supply means which is connected to the electrode means and to the mold.

3. A machine according to claim 2, wherein the mold is positioned as generally extending parallel to the moving plane of the moving means.

* * * * *